US007451561B2

(12) United States Patent
Weisbart

(10) Patent No.: US 7,451,561 B2
(45) Date of Patent: Nov. 18, 2008

(54) IDENTIFICATION TAG

(75) Inventor: Charles K. Weisbart, Indian Wells, CA (US)

(73) Assignee: It's . . . In The Bag! Inc., Palm Desert, CA (US)

( * ) Notice: Subject to any disclaimer, the term of this patent is extended or adjusted under 35 U.S.C. 154(b) by 417 days.

(21) Appl. No.: 10/642,015

(22) Filed: Aug. 15, 2003

(65) Prior Publication Data

US 2005/0034343 A1 Feb. 17, 2005

(51) Int. Cl.
*G09F 3/20* (2006.01)
*A44B 15/00* (2006.01)

(52) U.S. Cl. ..... 40/654.01; 40/634; 40/661.01

(58) Field of Classification Search ..... D3/247–248, D3/253; 224/604; 40/6, 651.01, 636, 661, 40/634; 150/147, 134
See application file for complete search history.

(56) References Cited

U.S. PATENT DOCUMENTS 1,255,961 A * 2/1918 Von Duyke ..... 206/38.1
1,359,320 A * 11/1920 Brenan ..... 281/4
3,279,107 A * 10/1966 Baumgartner ..... 40/633
3,961,431 A 6/1976 Kalenian
4,408,406 A 10/1983 Barton
4,570,688 A * 2/1986 Williams ..... 150/134
4,631,845 A 12/1986 Samuel et al.
4,901,462 A 2/1990 Wrigley
4,951,971 A 8/1990 Whited
4,978,144 A 12/1990 Schmidt et al.
5,051,565 A 9/1991 Wolfram
5,151,403 A 9/1992 Suzuki et al.
D336,780 S * 6/1993 Blankenship et al. ..... D3/248
5,226,809 A 7/1993 Franco
5,228,722 A 7/1993 Zoland
5,271,641 A 12/1993 Whited
5,294,466 A 3/1994 Baughman
5,303,956 A 4/1994 Zoland
5,381,617 A 1/1995 Schwartztol et al.
5,535,491 A 7/1996 Allport
5,900,307 A 5/1999 Barcikowski
6,098,253 A 8/2000 Nishida et al.
6,132,059 A 10/2000 Leibowitz
6,173,514 B1 1/2001 Peterson
6,248,451 B1 6/2001 Smith
6,321,965 B1 11/2001 Lavi et al.
6,408,660 B1 6/2002 Lai
6,550,813 B1 4/2003 Siegrist
2001/0054245 A1 * 12/2001 Williams ..... 40/661

* cited by examiner

*Primary Examiner*—Cassandra Davis
(74) *Attorney, Agent, or Firm*—Arent Fox LLP

(57) ABSTRACT

An identification tag includes a marker portion having first and second faces and first and second inside surfaces. Personalized identification indicia are applied to at least the first face, and a pocket assembly is attached to the first inside surface. The pocket assembly has an opening to receive a card bearing personal identification information, and other information. An attachment mechanism connected to the marker portion operates to secure the identification tag to a bag, a piece of luggage, or other personal belonging.

13 Claims, 3 Drawing Sheets

IDENTIFICATION TAG

BACKGROUND

1. Field

The present invention relates generally to identification labels, and more specifically, to unique tags for identifying luggage, bags and other personal items.

2. Background

It is frequently desirable to label packages, bags, and other personal belongings with identification tags that denote ownership of such items. For example, bags and suitcases often need to be identified from among a large group of other, similar bags and suitcases, such as on a luggage carousel at an airport or bus station. Sometimes, a person may mistakenly take a bag that looks similar to their own, but belongs to someone else. One means for verifying the identification of a single bag from among a group of other similar bags is by examining a label or luggage tag that bears the owner's identification information and is attached to the bag. This method requires that the owner make a preliminary identification based upon the bag's appearance, then verify the identification by examining the information contained on the luggage tag.

Unfortunately, although luggage tags are commonly used on luggage to verify an initial identification, they do not themselves typically assist owners in quickly identifying a bag or piece of luggage. Not only do many suitcases and other luggage pieces have similar designs and appearances, but so too do many luggage tags. Because of the substantial similarities and limited variety of luggage tags, many such tags that are currently used for luggage identification are not effective means for quickly identifying one bag from among a group of many bags. Instead, their usefulness is often limited to providing a means for verifying a preliminary identification that was previously made based upon the bag's own appearance. This method of initial bag identification is often difficult and inefficient, because of the subtle differences between many luggage pieces described above.

Another problem with such luggage tags is that they often are able to carry only a small amount of identification information. For example, many luggage tags include enough space to record an owner's name, address and phone number, but little else. This information may not be sufficient to reunite a lost bag with its owner while he is on a trip away from home, for example. The person who finds the bag will only have the limited information about the owner contained on the luggage tag, and will not inform the finder where the owner can be contacted before he returns home from his trip. Moreover, although the information recorded on a typical luggage tag may be limited, owners nevertheless often consider it confidential due to its personal nature. Thus, many typical luggage tags are problematic in that they display personal contact information on an outside surface of the tag, visible for all to see.

Therefore, what is needed is a means for quickly and easily identifying a bag or other personal item, even when it must be selected from among a group of many other similar bags or personal items bearing similarly designed luggage tags. What is also needed is a means for discreetly associating detailed personal information about a bag's owner with the bag itself.

SUMMARY

In one aspect of the present invention, an identification tag includes a marker portion having a first face with identification indicia, and also having a second face and first and second inside surfaces. The identification tag also includes an attachment mechanism connected to the marker portion, and a pocket assembly attached to the first inside surface.

In another aspect of the present invention, a method of making an identification tag includes cutting a strip from a roll of webbing, the strip having a body portion and first and second ends, applying identification indicia to a first surface of the body portion, and attaching a pocket to a second surface of the body portion that is opposite the first surface. The first end is folded over and secured to the second end such that the body portion comprises first and second layers and the pocket is between them.

It is understood that other embodiments of the present invention will become readily apparent to those skilled in the art from the following detailed description, wherein it is shown and described only exemplary embodiments of the invention by way of illustration. As will be realized, the invention is capable of other and different embodiments and its several details are capable of modification in various other respects, all without departing from the spirit and scope of the present invention. Accordingly, the drawings and detailed description are to be regarded as illustrative in nature and not as restrictive.

BRIEF DESCRIPTION OF THE DRAWINGS

Aspects of the present invention are illustrated by way of example, and not by way of limitation, in the accompanying drawings, wherein.

DETAILED DESCRIPTION

The detailed description set forth below in connection with the appended drawings is intended as a description of exemplary embodiments of the present invention and is not intended to represent the only embodiments in which the present invention can be practiced. The term "exemplary" used throughout this description means "serving as an example, instance, or illustration," and should not necessarily be construed as preferred or advantageous over other embodiments. The detailed description includes specific details for the purpose of providing a thorough understanding of the present invention. However, it will be apparent to those skilled in the art that the present invention may be practiced without these specific details.

Figure 1:
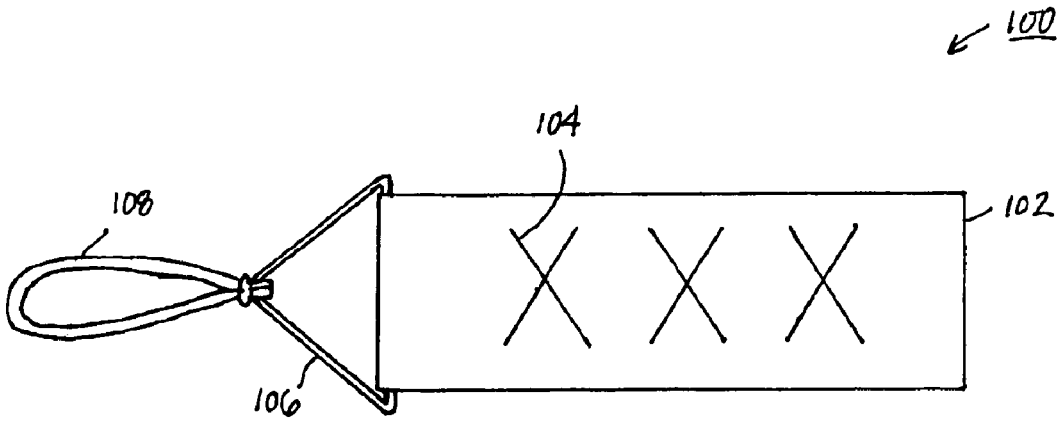
FIG. 1 illustrates an outer surface of an exemplary identification tag.

FIG. 1 illustrates an exemplary identification tag 100. When attached to a piece of luggage or other item, an eye-catching marker portion 102 of the identification tag distinguishes the item readily. The marker portion 102 may be eye-catching due to physical features such as its color, size, or shape. For example, bright colors would stand out in a large group of black bags to provide quick identification of one of them. The marker portion 102 may also be larger than ordinary luggage tags that have been previously known in the art, so that the identification tag 100 stands out from among other luggage tags. In an exemplary embodiment, marker portion 102 may be approximately 7 inches×1.5 inches or larger. Of course, the invention is not limited to any particular dimension or size. Accordingly, any numbers or quantities suggested herein are intended to serve as examples only.

In addition to or instead of its large size, the marker portion 102 may be eye-catching due to the identification indicia 104 that it bears. The indicia 104 may be applied to the marker portion 102 such as by embroidery or another form of stitching, or by applique, printing, or other form of transfer. In an exemplary embodiment, the indicia 104 is embroidered on both sides of the marker portion 102. Its color may contrast with the color of the marker portion 102, so as to be visually striking. In addition, the form and content of the indicia 104 may be designed or selected to be visually distinct. For instance, the indicia 104 may comprise a name or word that is meaningful to an owner of an item that is to be marked with the identification tag 100. The indicia 104 may also comprise a logo or other design that identifies a bag or item as unique. The size of indicia 104 may also be large so that it is easily noticed on the marker portion 102.

The exemplary identification tag 100 also comprises an attachment mechanism that may be used to secure the tag to a bag or other item that is to be marked. It will be recognized by those skilled in the art that various components can be used to construct an attachment mechanism, such as loops, hooks, rings, ties, buckles, brackets and the like. In the exemplary embodiment, the attachment mechanism includes a ring 106 and a loop 108. The ring 106 is attached directly to the marker portion 102, and may embody a triangular, rectangular, circular, D-shape or other form. In the exemplary embodiment, the ring 106 is welded steel, though other metals or materials, such as plastic, may be used instead. The loop 108 is connected to the ring 106 and used to attach the identification tag 100 to a bag or other item. The loop 108 may be formed of plastic, steel cable, nylon, or other strong, flexible component.

Figure 2:
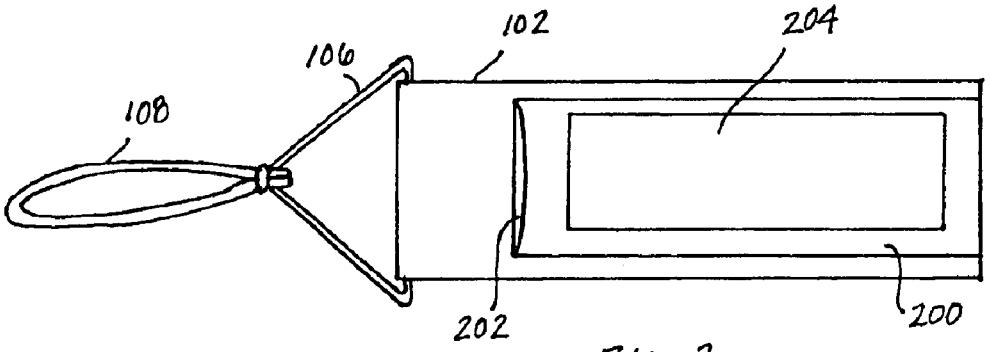
FIG. 2 illustrates an inner surface of an exemplary identification tag.

Another feature of the exemplary embodiment is an internal pocket 200, illustrated in FIG. 2. The pocket 200 is secured to the inner surface of the marker portion 102, and includes an opening 202 into which an information card 204 may be inserted. The information card 202 may be a single card including a small amount of information, or a full sheet of paper including a complete travel itinerary that is folded to fit into small opening 202. Other options for the card 202 include digital storage media, plastic smart cards, and other information storage devices. Alternatively, the card 204 may be a pre-printed form that can be filled in or marked upon by a user before insertion into the opening 202.

Opening 202 may be on one side of the pocket 200, as illustrated in FIG. 2, or it may be along an edge of the pocket 200. Alternatively, it may even comprise a slit in the face of the pocket 200. Also, the pocket 200 may be constructed of nylon, plastic, or other material, and may be opaque as to guard the contents of the card 202, or clear so as to visually reveal that information through the face of the pocket. In the exemplary embodiment, the pocket 200 is formed of plastic that is substantially clear, allowing 50% or more light transmission through it.

Figure 3:
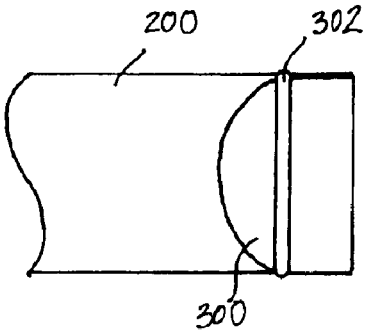
FIG. 3 illustrates a first alternative pocket arrangement for the exemplary identification tag.
Figure 4:
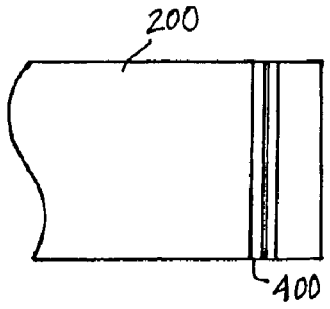
FIG. 4 illustrates a second alternative pocket arrangement for the exemplary identification tag.
Figure 5:
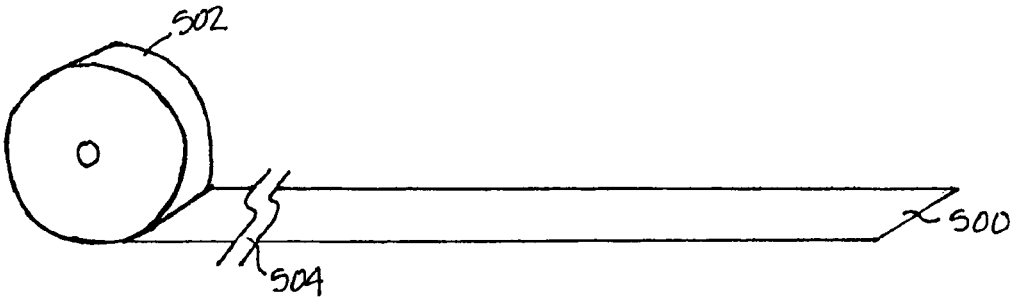
FIG. 5 illustrates a process for constructing a marker portion for an exemplary identification tag.

Opening 202 may have a number of different forms, some alternative embodiments of which are illustrated in FIG. 3 and FIG. 4, for example. FIG. 3 illustrates a pocket closure mechanism comprising a flap 300 that may be folded over the pocket opening to secure the pocket contents therein. A restraint loop 302 holds the flap 300 securely in place. In another alternative embodiment, illustrated in FIG. 4, a pocket closure mechanism includes a pressure seal 400. The pocket opening is sealed by applying pressure to a ridge along one side of the opening, which presses the ridge into a groove along the other side of the opening, thereby sealing the pocket at its opening. This type of mechanism may be opened and re-sealed multiple, repeated times.

Figure 6:
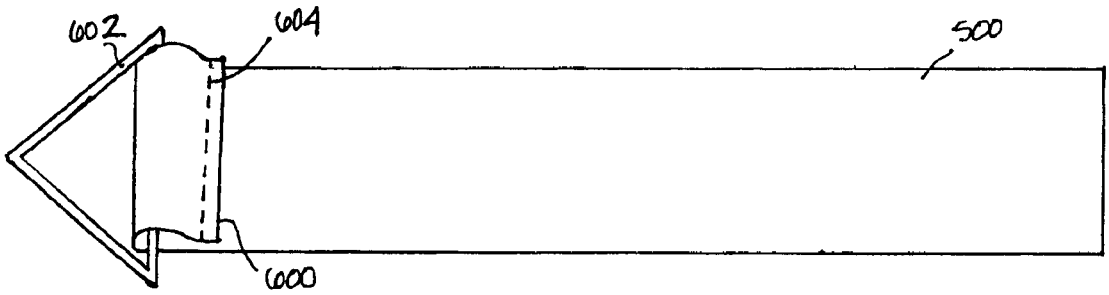
FIG. 6 illustrates a method of attaching a ring to the marker portion as part of manufacturing the exemplary identification tag.

FIGS. 5-9 illustrate an exemplary process for manufacturing the exemplary identification tag. First, a strip 500 of webbing, such as polypropylene or nylon webbing, is cut from a roll 502. The webbing may be between 1 and 2 inches in width, and may come in rolls of 100 yards, though it is not limited to such dimensions. The strip 502 is cut at location 504 designated so as to cause the strip to be slightly longer than two times the desired length of the finished identification tag. As illustrated in FIG. 6, after the strip 500 is cut, one end 600 is folded over, inserted through a ring 602, and secured to the body of the strip 500 such as by stitching 604.

Figure 7A:
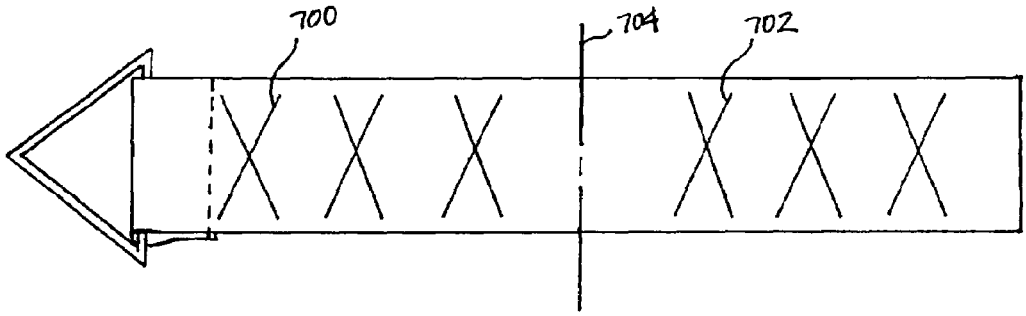
FIGS. 7A and 7B illustrate the application of identification indicia and a pocket to the marker portion.

Next, the identification tag is turned over, as illustrated in FIG. 7A, so that indicia 700 and 702 may be applied to the opposite face of the strip. In one embodiment, the indicia are placed on either side of the strip, such that when the strip is eventually folded over to form the dual sided identification tag, one indicia, 700 or 702, is located on each of the two sides. Of course, the identification tag may bear only one indicia, such that when it is folded over it only bears identification indicia on one of its two sides. In either case, the indicia 700 and 702 may be pre-determined words, numbers, symbols, logos or the like. Alternatively, the indicia 700 and 702 may be customized in accordance with a particular request from a customer. For example, a customer may order an identification tag bearing his own name. The request for indicia 700 and 702 to each comprise the customer's name would be received, and the customer's name would be applied to the strip as indicia 700 and 702.

Figure 7B:
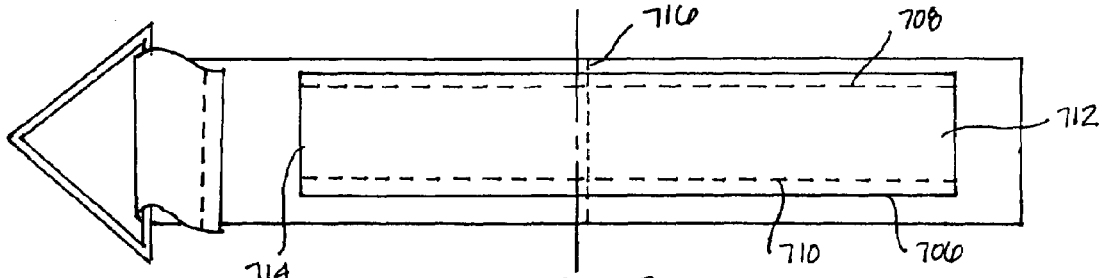

FIG. 7B illustrates the strip turned over again, to expose the other side, which will become the inside surface of the identification tag after the folding operation introduced above and described in further detail below. On this inside surface, a pocket 706 is attached, such as by two rows of stitching 708 and 710. Open ends 712 and 714 remain unstitched and will serve as openings through which the pocket may receive a card or other insert. Another row of stitching 716 may optionally be located approximately through the center of the pocket in order to form two separate pockets, each having its own opening, open end 712 or open end 714.

Figure 8:
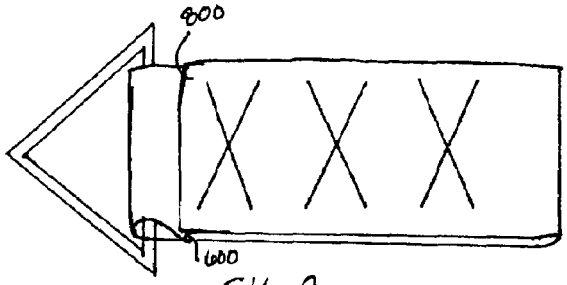
FIG. 8 illustrates folding the marker portion over to construct a dual-sided marker portion for the exemplary identification tag.
Figure 9:
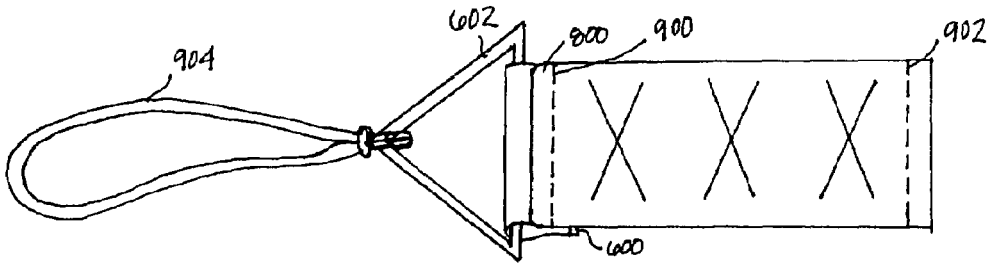
FIG. 9 illustrates final stitching and attachment of a securing loop to the marker portion to complete construction of the exemplary identification tag.

FIG. 8 illustrates the far end of the strip 800 being folded over toward the previously folded end 600 to form the dual sided identification tag having the pocket 706 on the inside surfaces. FIG. 9 illustrates the final operations in constructing the exemplary identification tag, in which folded over end 800 is secured to the other folded-over end 600 and secured thereto by stitching 900. Another row of stitching 902 may be sewn along the opposite end of the identification tag to secure the two halves of the strip together and better enclose the pockets therein. Stitching 902 may also serve to separate the pocket 706 into two separate pockets if the optional stitching 716 illustrated in FIG. 7B is not used. Finally, loop 904 is attached to ring 602 as a securing means for attaching the finished identification tag to a bag or other item to be marked. Loop 904 may be plastic, nylon cord, steel cable, or any other strong, flexible material.

The various figures and diagrams described in connection with the embodiments disclosed herein may be implemented or performed with webbing, fabric, loops, rings, cable, other attachment mechanisms or any combination thereof designed to perform the functions described herein. The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. For example, the identification tag may be formed by more than two layers of a folded webbing strip, or by a single unfolded layer. The folds may be performed in a different order or arrangement than those described herein. Also, the internal pocket may comprise only one such pocket, rather than two pockets. Further, it will be recognized by those skilled in the art that a variety of other materials may be used to construct a durable identification tag with an internal pocket and outer identification indicia as described herein. Thus, the present invention is not intended to be limited to the embodiments shown herein but is to be accorded the widest scope consistent with the principles and novel features disclosed herein.

What is claimed is:

1. An identification tag, comprising:

a marker portion including a first face having identification indicia, the marker portion further including a second face and first and second inside surfaces;

an attachment mechanism connected to a first end of the marker portion; and a pocket assembly attached to the first inside surface, wherein the pocket assembly is constructed of plastic that is substantially clear, includes an opening into which a card may be inserted between the pocket assembly and the first inside surface, and is additionally attached to the second inside surface and includes a second opening into which a second card may be inserted between the pocket assembly and the second inside surface;

wherein the first and second faces are non-releasably secured together at the first end and a second end, wherein the second end is substantially opposite the first end.

2. The identification tag of claim 1 further comprising identification indicia on the second face.

3. The identification tag of claim 1 wherein the identification indicia is personalized to a user.

4. An identification tag, comprising:

a marker portion including a first face having identification indicia, the marker portion further including a second face and first and second inside surfaces, wherein the identification indicia is embroidered onto the first face;

an attachment mechanism connected to a first end of the marker portion; and a pocket assembly attached to the first inside surface, wherein the pocket assembly is constructed of plastic that is substantially clear;

wherein the first and second faces are non-releasably secured together at the first end and a second end, wherein the second end is substantially opposite the first end.

5. The identification tag of claim 4 further comprising identification indicia on the second face.

6. The identification tag of claim 4 wherein the identification indicia is personalized to a user.

7. An identification tag, comprising:

a marker portion including a first face having identification indicia, the marker portion further including a second face and first and second inside surfaces;

an attachment mechanism connected to a first end of the marker portion, wherein the attachment mechanism comprises a ring attached to the marker portion; and a pocket assembly attached to the first inside surface, wherein the pocket assembly is constructed of plastic that is substantially clear;

wherein the first and second faces are non-releasably secured together at the first end and a second end, wherein the second end is substantially opposite the first end.

8. The identification tag of claim 7 wherein the attachment mechanism further comprises a flexible loop attached to the ring and connectable to an item to be identified with the identification tag.

9. The identification tag of claim 7 further comprising identification indicia on the second face.

10. The identification tag of claim 7 wherein the identification indicia is personalized to a user.

11. An identification tag, comprising:

a marker portion including a first face having identification indicia, the marker portion further including a second face and first and second inside surfaces, wherein the marker portion is constructed from polypropylene webbing material and the identification indicia are embroidered with nylon thread;

an attachment mechanism connected to a first end of the marker portion, wherein the attachment mechanism comprises a steel ring and a plastic loop; and a pocket assembly attached to the first inside surface, wherein the pocket assembly comprises substantially clear plastic;

wherein the first and second faces are non-releasably secured together at the first end and a second end, wherein the second end is substantially opposite the first end.

12. The identification tag of claim 11 further comprising identification indicia on the second face.

13. The identification tag of claim 11 wherein the identification indicia is personalized to a user.

* * * * *